US011555289B2

(12) United States Patent
McGregor et al.

(10) Patent No.: US 11,555,289 B2
(45) Date of Patent: Jan. 17, 2023

(54) CONSTRUCTION VEHICLE

(71) Applicant: Caterpillar Inc., Peoria, IL (US)

(72) Inventors: Scott Andrew McGregor, Chicago, IL (US); Abraham Lawson, Marshall, NC (US); Jose Lujano, Plano, IL (US); Daniel Allen Hatfield, Rochelle, IL (US)

(73) Assignee: Caterpillar Inc., Peoria, IL (US)

( * ) Notice: Subject to any disclaimer, the term of this patent is extended or adjusted under 35 U.S.C. 154(b) by 276 days.

(21) Appl. No.: 16/916,788

(22) Filed: Jun. 30, 2020

(65) Prior Publication Data

US 2021/0404143 A1 Dec. 30, 2021

(51) Int. Cl.

| | |
|---|---|
| ***E02F 9/00*** | (2006.01) |
| ***E02F 9/08*** | (2006.01) |
| ***E02F 3/28*** | (2006.01) |
| ***E02F 9/16*** | (2006.01) |

(52) U.S. Cl.

CPC ..... *E02F 9/0891* (2013.01); *E02F 3/283* (2013.01); *E02F 9/0808* (2013.01); *E02F 9/16* (2013.01)

(58) Field of Classification Search

CPC ..... E02F 9/0891; E02F 3/283; E02F 9/0808; E02F 9/16

See application file for complete search history.

(56) References Cited

U.S. PATENT DOCUMENTS

| | | | | |
|---|---|---|---|---|
| 2,197,648 | A * | 4/1940 | Mersheimer | B62D 25/105 16/370 |
| 3,508,784 | A | 4/1970 | Small | |
| 4,382,312 | A * | 5/1983 | Liggett | E05D 3/145 16/370 |
| 5,535,846 | A * | 7/1996 | Kurtz, Jr. | B62D 25/10 180/69.21 |
| 5,579,860 | A * | 12/1996 | Halverson | B62D 33/0604 296/190.07 |
| 5,803,198 | A * | 9/1998 | Baxter | B62D 25/10 180/69.21 |
| 5,890,556 | A * | 4/1999 | Shearn | B62D 33/07 180/69.21 |
| 6,041,880 | A | 3/2000 | Yamakaji et al. | |
| 6,460,644 | B1 * | 10/2002 | Smith | B62D 25/10 180/89.17 |

(Continued)

FOREIGN PATENT DOCUMENTS

CA 999327 11/1976

*Primary Examiner* — Hau V Phan

(57) ABSTRACT

A construction vehicle includes a chassis having a front end and a rear end. The construction vehicle also includes an operator cabin supported by the chassis and a hood proximate to the rear end of the chassis. The construction vehicle further includes a hood structure for supporting the hood. The hood structure includes a first frame member coupled to the chassis proximate to the rear end and a second frame member disposed distal to the rear end and proximal to the operator cabin. The second frame member is coupled to the chassis by a mounting assembly. The mounting assembly includes a plate member connected to the second frame member. The mounting assembly also includes a first mounting device connecting a first end of the plate member to the chassis. The mounting assembly further includes a second mounting device connecting a second end of the plate member to the chassis.

16 Claims, 5 Drawing Sheets

(56) References Cited

U.S. PATENT DOCUMENTS

| | | | | |
|---|---|---|---|---|
| 6,487,754 | B1 * | 12/2002 | Keen | B62D 25/10 296/100.1 |
| 6,701,574 | B2 * | 3/2004 | Hashim | E05F 1/1276 16/370 |
| 6,834,735 | B2 * | 12/2004 | Kim | E05D 3/145 180/274 |
| 6,910,545 | B2 * | 6/2005 | Haun | E05F 1/1276 180/69.2 |
| 6,997,276 | B2 | 2/2006 | Yoshida et al. | |
| 8,443,923 | B2 * | 5/2013 | Brosz | B62D 33/0604 403/220 |
| 8,641,093 | B1 * | 2/2014 | Knight | B60R 21/11 296/96.13 |
| 8,899,363 | B1 * | 12/2014 | LaPorte | B62D 25/12 180/69.2 |
| 8,967,310 | B2 | 3/2015 | Ogawara et al. | |
| 9,549,503 | B2 * | 1/2017 | Dupon | B62D 33/0604 |
| 9,683,348 | B2 | 6/2017 | Mitsuda | |
| 10,315,612 | B2 * | 6/2019 | Yamada | B60R 21/38 |
| 10,689,039 | B2 * | 6/2020 | Kurokawa | A01B 69/001 |
| 10,822,034 | B2 * | 11/2020 | Pilney | B62D 27/02 |
| 2004/0216934 | A1 * | 11/2004 | Tomiyama | B62D 25/10 180/68.1 |
| 2009/0194348 | A1 * | 8/2009 | Faubert | E05F 1/1207 296/193.11 |
| 2013/0175109 | A1 | 7/2013 | Takatsuji | |
| 2014/0070569 | A1 * | 3/2014 | Schmitz | B60J 10/20 296/193.11 |

* cited by examiner

CONSTRUCTION VEHICLE

TECHNICAL FIELD

The present disclosure relates to a construction vehicle, and more particularly to a hood structure for a construction vehicle.

BACKGROUND

Construction vehicle, such as a wheel loader, includes a hood to enclose a power source of the vehicle. The hood is disposed at a rear end of a chassis of the vehicle. In some vehicles, the hood includes a gull wing hood design. In such designs, the hood is fixed to the chassis of the construction vehicle and a side door is provided at each side of the hood for service access. Typically, a hood structure couples the hood to the chassis and also supports the side doors and panels of the hood.

During a stock piling operation, a counterweight of the vehicle may hit the ground. This event may cause a twisting of the chassis. Furthermore, the torsional stiffness of the chassis increases from the rear end of the chassis as it transitions towards a front end of the chassis. Accordingly, the portion of the hood structure that is disposed proximate to the rear end of the chassis has low torsional stiffness relative to the chassis and may be subjected to high twisting imparted by the chassis. Further, a portion of the hood structure that is disposed distal to the rear end of the chassis has higher torsional stiffness and may be subjected to low twisting. The twisting of the chassis may manifest itself in an energy that may be absorbed by the hood structure. This phenomenon may cause high stresses and propagation of cracks in the hood structure. Further, resultant forces from these events may cause loosening or slipping of mounting bolts between the hood structure and the chassis. In some cases, twisting forces experienced by the hood structure may reduce a life of a base portion of the hood structure.

U.S. Pat. No. 8,443,923 describes a vibration isolator device securing a nonmetal panel to a metal frame of a work vehicle. The vibration isolator device includes a metal member affixed to a surface of the nonmetal panel, the metal member facing the metal frame. An isolator mount plate is secured to the frame in a manner permitting a predetermined adjustment between the isolator mount plate and the frame in each of two directions. A vibration isolator is positioned between the metal member and the frame. A region of the isolator mount plate is configured to receive and maintain vibration isolation between the region of the isolator mount plate and the metal member. The region of the isolator mount plate provides a predetermined adjustment between the isolator mount plate and the metal member in a third direction.

SUMMARY OF THE DISCLOSURE

In an aspect of the present disclosure, a construction vehicle is provided. The construction vehicle includes a chassis having a front end and a rear end opposite to the front end. The construction vehicle also includes an operator cabin supported by the chassis. The construction vehicle further includes a hood proximate to the rear end of the chassis. The construction vehicle includes a hood structure for supporting the hood. The hood structure includes a first frame member coupled to the chassis proximate to the rear end and a second frame member disposed distal to the rear end and proximal to the operator cabin. The second frame member is coupled to the chassis by a mounting assembly. The mounting assembly includes a plate member connected to the second frame member. The plate member has a first end and a second end. The mounting assembly also includes a first mounting device connecting the first end of the plate member to the chassis. The mounting assembly further includes a second mounting device connecting the second end of the plate member to the chassis.

In another aspect of the present disclosure, a wheel loader is provided. The wheel loader includes a chassis having a front end and a rear end opposite to the front end. The wheel loader also includes an operator cabin supported by the chassis. The wheel loader further includes a hood proximate to the rear end of the chassis. The wheel loader includes a hood structure for supporting the hood. The hood structure includes a first frame member coupled to the chassis proximate to the rear end and a second frame member disposed distal to the rear end and proximal to the operator cabin. The second frame member is coupled to the chassis by a mounting assembly. The mounting assembly includes a plate member connected to the second frame member. The plate member has a first end and a second end. The mounting assembly also includes a first mounting device connecting the first end of the plate member to the chassis. The mounting assembly further includes a second mounting device connecting the second end of the plate member to the chassis.

Other features and aspects of this disclosure will be apparent from the following description and the accompanying drawings.

DETAILED DESCRIPTION

Figure 1:
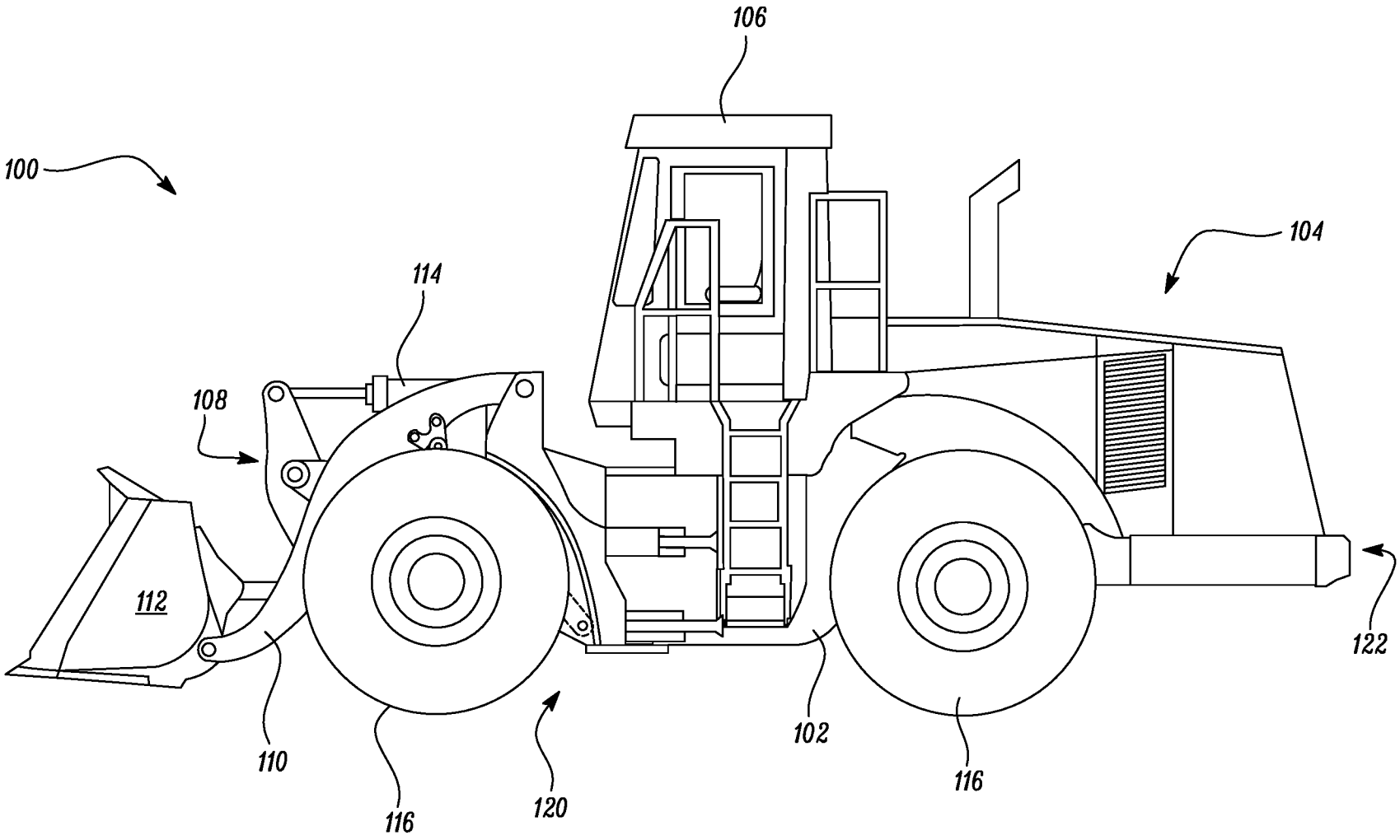
FIG. 1 is a side view of a construction vehicle, according to an embodiment of the present disclosure.

Wherever possible, the same reference numbers will be used throughout the drawings to refer to the same or like parts. Referring to FIG. 1, a side view of an exemplary construction vehicle 100 is illustrated. The construction vehicle 100 is embodied as a wheel loader that may be used for purposes such as construction, landscaping, agriculture, and the like. The construction vehicle 100 may be hereinafter interchangeably referred to as the wheel loader 100, without limiting the scope of the present disclosure. Alternatively, the construction vehicle 100 may be embodied as off highway trucks, dozers, excavators, tractors, motor graders, scrapers, etc. that may be used in various industries to move or load materials such as asphalt, debris, dirt, snow, feed, gravel, logs, raw minerals, recycled material, rock, sand, woodchips, etc.

The construction vehicle 100 includes a chassis 102 having a front end 120 and a rear end 122 opposite to the front end 120. The chassis 102 supports various components of the construction vehicle 100, such as a power source (not shown), thereon. The power source may include an engine, such as an internal combustion engine, batteries, motors, and the like. The power source provides power to the construction vehicle 100 for operational and mobility requirements. The construction vehicle 100 further includes an operator cabin 106 supported by the chassis 102. The operator cabin 106 includes one or more controls (not shown), such as joysticks, pedals, levers, buttons, switches, knobs, audio visual devices, operator consoles, a steering wheel, and the like. The controls may enable an operator to control the construction vehicle 100 during operation. The construction vehicle 100 includes a hood 104 proximate to the rear end 122 of the chassis 102. The hood 104 encloses the power source therein. The hood 104 may include one or more side doors to provide service access.

The construction vehicle 100 also includes a linkage assembly 108 movably coupled to the chassis 102. The linkage assembly 108 includes an arm 110 movably coupled to the chassis 102 and an implement 112 movably coupled to the arm 110. The implement 112 is used to perform one or more work operations, such as loading, stock piling, dumping, and the like. The linkage assembly 108 also includes one or more hydraulic actuators 114 in order to provide movement of the linkage assembly 108. The construction vehicle 100 further includes a number of wheels 116. The wheels 116 provide support and mobility to the construction vehicle 100 on grounds. Although the construction vehicle 100 is illustrated as a wheel loader herein, those skilled in the art will appreciate that the construction vehicle 100 may embody any other known vehicle having the hood 104.

Figure 2:
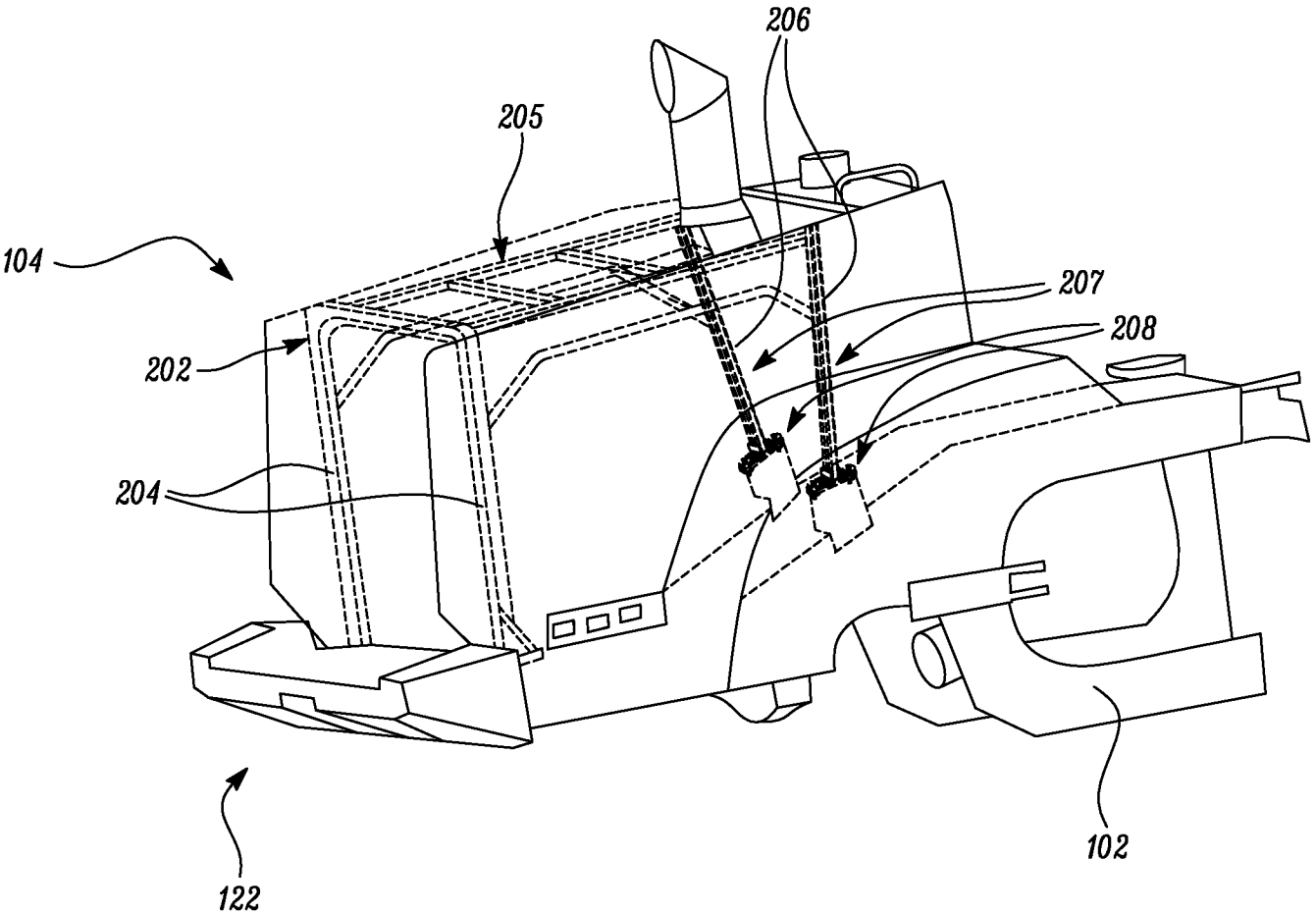
FIG. 2 is a perspective view illustrating a hood, a hood structure, and a chassis associated with the construction vehicle of FIG. 1.

Referring to FIG. 2, a perspective view of the rear end 122 of the chassis 102 is illustrated, in accordance with an embodiment of the present disclosure. As illustrated, the construction vehicle 100 includes a hood structure 202 for supporting the hood 104. The hood structure 202 may be defined as a structure including a number of frame members and weldments that are secured to the chassis 102 to provide structural strength and stability to the hood 104.

The hood structure 202 includes a first frame member 204 coupled to the chassis 102 proximate to the rear end 122 and a second frame member 206 disposed distal to the rear end 122 and proximal to the operator cabin 106 (see FIG. 1). The first frame member 204 may embody a metallic column or a metallic bar. The first frame member 204 may include a square cross-section, a rectangular cross-section, or a circular cross-section. In some embodiments, the first frame member 204 may be welded to the chassis 102 proximate to the rear end 122. In other embodiments, the first frame member 204 may be coupled to the chassis 102 using mechanical fasteners (not shown). In the embodiment illustrated in FIG. 2, the hood structure 202 includes two first frame members 204. In some other embodiments, a total number of the first frame members 204 may vary, as per application requirements.

Further, the hood structure 202 includes a frame portion 205 disposed between the first frame members 204 and the second frame members 206. The frame portion 205 may include a number of bar members that are arranged between the first and second frame member 204, 206. The second frame member 206 may embody a metallic column or a metallic bar. The second frame member 206 may include a square cross-section, a rectangular cross-section, or a circular cross-section. In the embodiment illustrated in FIG. 2, the hood structure 202 includes two second frame members 206. In other embodiments, a total number of the second frame members 206 may vary, as per application requirements. Further, each second frame member 206 defines a lower end 207. Moreover, each second frame member 206 includes a foot portion 226 (shown in FIG. 3) disposed proximate to the lower end 207. The second frame member 206 is coupled to the chassis 102 by a mounting assembly 208. Specifically, the lower end 207 of the second frame member 206 is coupled to the chassis 102 by the mounting assembly 208.

Figure 3:
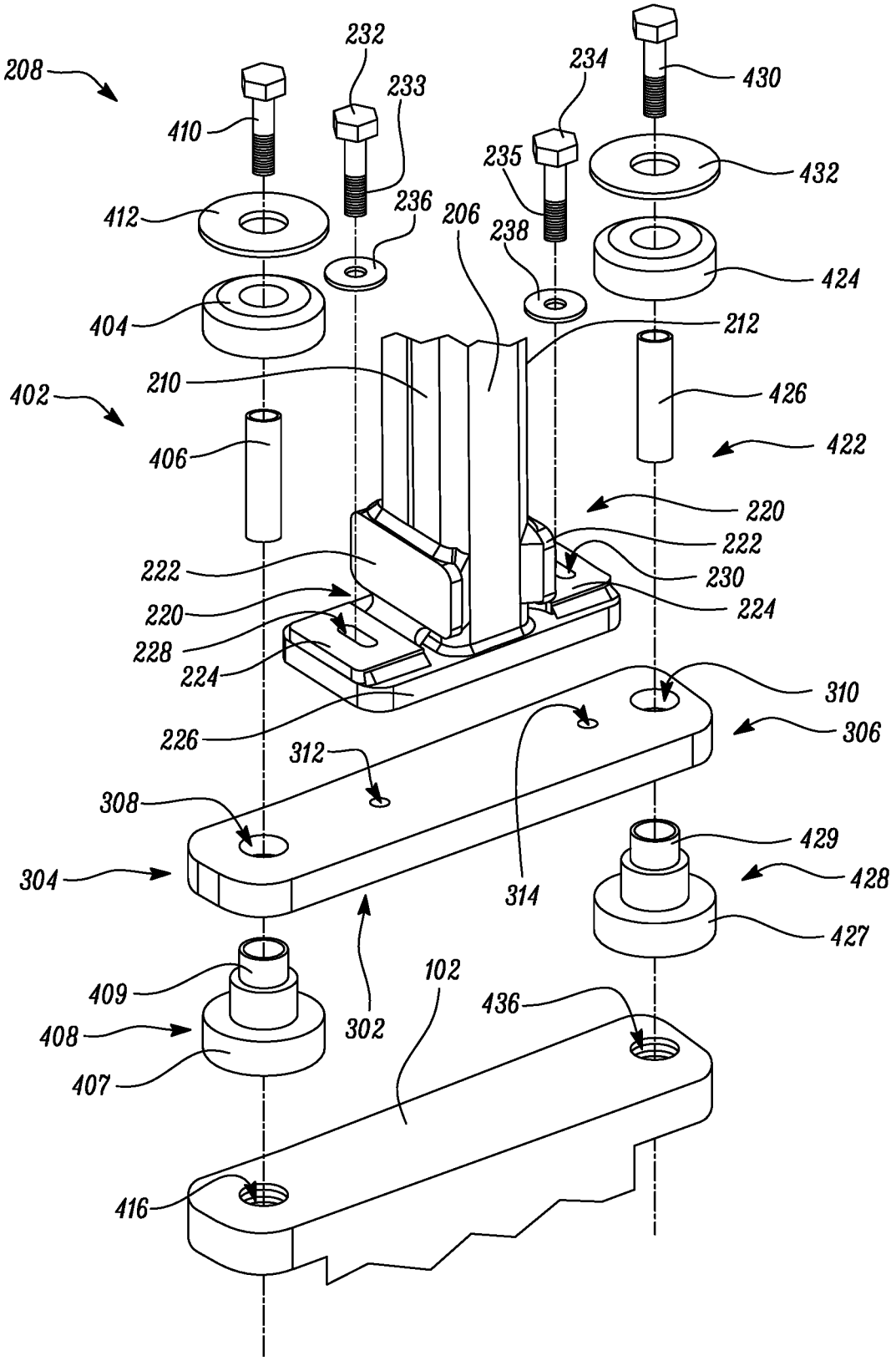
FIG. 3 is an exploded view illustrating a mounting assembly associated with the hood structure of FIG. 2.

It should be noted that each second frame member 206 includes similar structure and design. The present disclosure will now be explained in relation to coupling of one second frame member 206 with the chassis 102. However, the details provided below is applicable to both second frame members 206. Referring to FIG. 3, the second frame member 206 defines a first surface 210 and a second surface 212 opposite to the first surface 210. The lower end 207 of the second frame member 206 includes a pair of bracket members 220 that are identical to each other. In the illustrated embodiment, each bracket member 220 is substantially L-shaped. Each bracket member 220 includes a first flange 222 and a second flange 224 that is perpendicular to the first flange 222. The first flange 222 of each bracket member 220 is attached to the first and second surfaces 210, 212, respectively. In some embodiments, the first flange 222 of the corresponding bracket member 220 may be welded to the first and second surfaces 210, 212, respectively.

The second flange 224 of each bracket member 220 is attached to the foot portion 226 of the second frame member 206. In some embodiments, the second flange 224 of each bracket member 220 may be welded to the foot portion 226. In other embodiments, the bracket members 220 may be an integral part of the second frame member 206. It should be noted that a design of each bracket member 220 shown herein is exemplary in nature and each bracket member 220 may include any other design, without any limitations. Moreover, the second frame member 206 defines a first slot 228 and a second slot 230. Specifically, the first and second slots 228, 230 are defined by the foot portion 226 and the second flange 224 of the corresponding bracket member 220. As illustrated, the first and second slots 228, 230 have an oblong shape.

Figure 4:
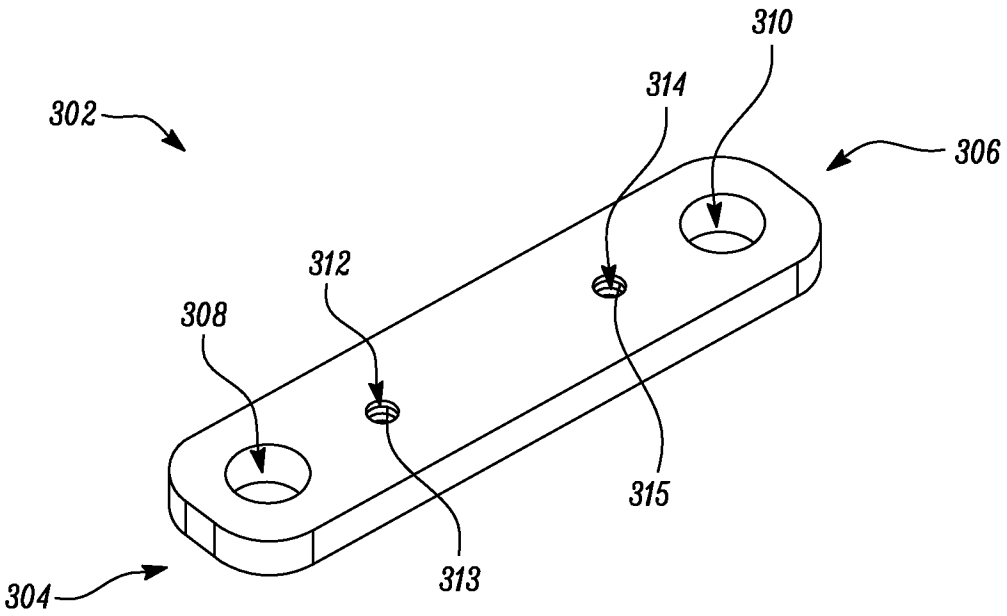
FIG. 4 is a perspective view of a plate member of the mounting assembly of FIG. 3.

Further, the mounting assembly 208 includes a plate member 302 connected to the second frame member 206. The plate member 302 has a first end 304 and a second end 306 opposite to the first end 304. Referring to FIG. 4, the plate member 302 includes a first opening 308 proximate to the first end 304. The plate member 302 also includes a second opening 310 proximate to the second end 306. Moreover, the plate member 302 defines a first through-hole 312 proximate to the first opening 308. The plate member 302 further defines a second through-hole 314 proximate to the second opening 310. Each of the first and second through-holes 312, 314 include helical threads 313, 315. In the illustrated embodiment, the plate member 302 has an oblong shape. In other embodiments, a shape of the plate member 302 may vary, for example the plate member 302 may have a rectangular shape, depending on application requirements.

Referring to FIG. 3, the plate member 302 defines the first through-hole 312 that aligns with the first slot 228 in the second frame member 206 for receiving a third mechanical fastener 232 and the second through-hole 314 that aligns with the second slot 230 in the second frame member 206 for receiving a fourth mechanical fastener 234. The third and fourth mechanical fasteners 232, 234 couple the second frame member 206 to the plate member 302. Further, the third and fourth mechanical fasteners 232, 234 include threads 233, 235 that engage with the helical threads 313, 315 of the first and second through-holes 312, 314, respectively. In the illustrated embodiment, the third and fourth mechanical fasteners 232, 234 are embodied as bolts. Alternatively, the third and fourth mechanical fasteners 232, 234 may be embodied as screws, pins, and the like. Further, a third washer 236 is associated with the third mechanical fastener 232. Similarly, a fourth washer 238 is associated with the fourth mechanical fastener 234. The third and fourth washers 236, 238 may provide uniform load distribution, spacing, and vibration absorption at a connection between the plate member 302 and the second frame member 206.

Figure 5:
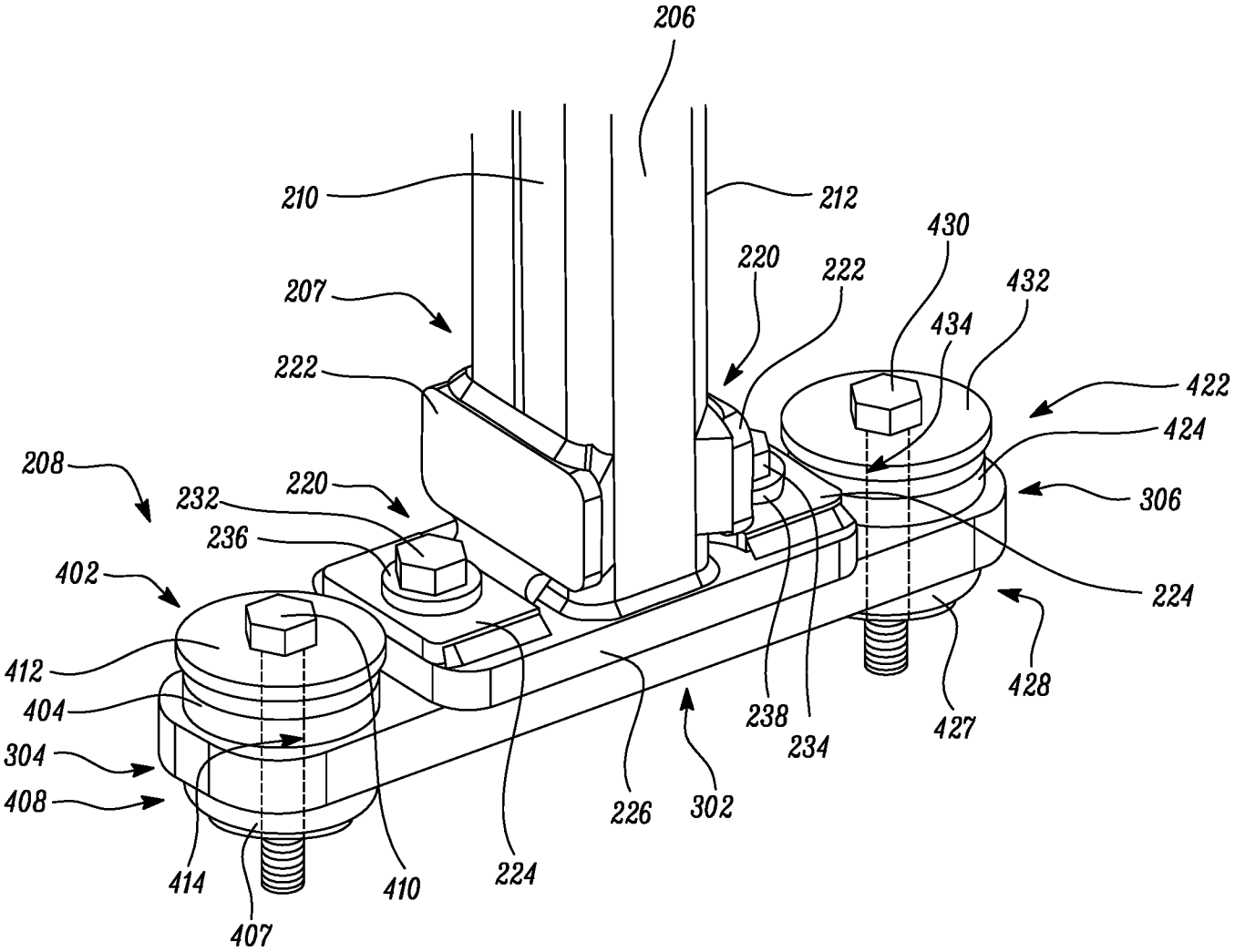
FIG. 5 is a perspective view illustrating a second frame member coupled to the chassis by the mounting assembly of FIG. 3.

Referring to FIGS. 3 and 5, the mounting assembly 208 also includes a first mounting device 402 connecting the first end 304 of the plate member 302 to the chassis 102. The mounting assembly 208 further includes a second mounting device 422 connecting the second end 306 of the plate member 302 to the chassis 102. Each of the first and second mounting devices 402, 422 includes an isolation mount. The first and second mounting devices 402, 422 allow removably coupling of the plate member 302 to the chassis 102.

The first mounting device 402 includes a first upper mount 404, a first sleeve member 406 (shown in FIG. 3), a first lower mount 408, a first mechanical fastener 410, and a first washer 412. In an assembled state of the first mounting device 402, the first washer 412 is disposed between a head portion of the first mechanical fastener 410 and the first upper mount 404. It should be noted that the first upper mount 404, the first sleeve member 406, and the first lower mount 408 are made of a flexible material, such as rubber. The first upper mount 404 includes a disc shaped structure.

Further, the first sleeve member 406 is disposed around the first mechanical fastener 410 and extends around half of an overall length of the first mechanical fastener 410. The first sleeve member 406 is embodied as a generally tubular member defining a hollow portion for receiving the first mechanical fastener 410. The first upper and lower mounts 404, 408 are disposed around the first sleeve member 406. The first opening 308 receives the first sleeve member 406 of the first mounting device 402. Moreover, the first lower mount 408 includes a stepped design. More particularly, the first lower mount 408 includes a first portion 407 and a second portion 409 (shown in FIG. 3). The first portion 407 has a diameter that is greater than a diameter of the second portion 409.

The first mounting device 402 further defines a first through-aperture 414 (shown in FIG. 5). More particularly, the first through-aperture 414 is defined by the first washer 412, the first upper mount 404, the first sleeve member 406 (shown in FIG. 3), and the first lower mount 408. Moreover, the first through-aperture 414 in the first mounting device 402 aligns with the first opening 308 (shown in FIGS. 3 and 4) in the plate member 302. Further, the first opening 308 in the plate member 302 and the first through-aperture 414 in the first mounting device 402 align with a first aperture 416 (shown in FIG. 3) in the chassis 102 for receiving the first mechanical fastener 410 therethrough. The first mechanical fastener 410 couples the plate member 302 to the chassis 102 proximate to the first end 304 of the plate member 302. More particularly, the first mechanical fastener 410 removably couples the plate member 302 to the chassis 102 proximate to the first end 304 of the plate member 302.

In the illustrated embodiment, the first mechanical fastener 410 is embodied as a bolt. Alternatively, the first mechanical fastener 410 may be embodied as screws, pins, and the like. It should be noted that design and details of various components of the first mounting device 402 described herein is exemplary in nature, and the first mounting device 402 may include any other design or combination of components generally known in the art, without any limitations.

Further, the second mounting device 422 includes a second upper mount 424, a second sleeve member 426, a second lower mount 428, a second mechanical fastener 430, and a second washer 432. In an assembled state of the second mounting device 422, the second washer 432 is disposed between a head portion of the second mechanical fastener 430 and the second upper mount 424. It should be noted that the second upper mount 424, the second sleeve member 426, and the second lower mount 428 are made of a flexible material, such as rubber. The second sleeve member 426 is disposed around the second mechanical fastener 430 and extends around half of an overall length of the second mechanical fastener 430.

Further, the second upper mount 424 includes a disc shaped structure. Moreover, the second sleeve member 426 is embodied as a generally tubular member defining a hollow portion for receiving the second mechanical fastener 430. The second upper and lower mounts 424, 428 are disposed around the second sleeve member 426. The second opening 310 receives the second sleeve member 426 of the second mounting device 422. Moreover, the second lower mount 428 includes a stepped design. More particularly, the second lower mount 428 includes a third portion 427 and a fourth portion 429 (shown in FIG. 3). The third portion 427 has a diameter that is greater than a diameter of the fourth portion 429.

The second mounting device 422 further defines a second through-aperture 434 (shown in FIG. 5). More particularly, the second through-aperture 434 is defined by the second washer 432, the second upper mount 424, the second sleeve member 426, and the second lower mount 428. Further, the second through-aperture 434 in the second mounting device 422 aligns with the second opening 310 (shown in FIGS. 3 and 4) in the plate member 302. Moreover, the second opening 310 in the plate member 302 and the second through-aperture 434 in the second mounting device 422 align with a second aperture 436 (shown in FIG. 3) in the chassis 102 for receiving the second mechanical fastener 430 therethrough. The second mechanical fastener 430 couples the plate member 302 to the chassis 102 proximate to the second end 306 of the plate member 302. More particularly, the second mechanical fastener 430 removably couples the plate member 302 to the chassis 102 proximate to the second end 306 of the plate member 302.

In the illustrated embodiment, the second mechanical fastener 430 is embodied as a bolt. Alternatively, the second mechanical fastener 430 may be embodied as screws, pins, and the like. It should be noted that design and details of various components of the second mounting device 422 described herein is exemplary in nature, and the second mounting device 422 may include any other design or combination of components generally known in the art, without any limitations.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The mounting assembly 208 described herein provides a simple, robust, and flexible coupling between the second frame member 206 of the hood structure 202 and the chassis 102 of the construction vehicle 100. Further, the disclosed mounting assembly 208 includes the first and second mounting devices 402, 422 to absorb energy and twisting forces induced in the construction vehicle 100 during operations, such as stock piling operations. Thus, the first and second mounting devices 402, 422 may isolate the hood structure 202 from the twisting forces. The first and second mounting devices 402, 422 includes components that are made of rubber. Accordingly, the mounting devices may hold an axial and radial stiffness.

The first and second mounting devices 402, 422 removably couple the hood structure 202 to the chassis 102 at locations where a higher amount of twisting forces are induced in the hood structure 202. The first and second mounting devices 402, 422 may allow a higher tolerance for deflection when the chassis 102 is subjected to twisting. In the illustrated embodiment, each of the first and second mounting devices 402, 422 may displace in a radial direction and an axial direction, based on the twisting of the chassis 102. More particularly, the first and second mounting devices 402, 422 may allow the induced energy due to the twisting of the chassis 102 to be dissipated in displacement of the first and second mounting devices 402, 422.

The mounting assembly 208 may prevent twisting and cracking of the hood structure 202. Furthermore, the first and second mounting devices 402, 422 may be designed in such a way that they are not over displaced by twisting forces. Therefore, the mounting assembly 208 may reduce stresses and forces in the hood structure 202 and may improve a life of the hood structure 202 and the hood 104. Further, the mounting assembly 208 includes the plate member 302. The plate member 302 allows connection of the second frame member 206 with the chassis 102. Moreover, the plate member 302 may allow manufacturing tolerance variation in the mounting assembly 208 to assure correct alignment of the first and second mounting devices 402, 422. With the inclusion of the plate member 302, the first and second slots 228, 230 may be added to the second frame member 206 of the hood structure 202 for dimensional tolerances and coupling the mounting assembly 208 to the chassis 102.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof

What is claimed is:

1. A construction vehicle comprising:

a chassis having a front end and a rear end opposite to the front end;

an operator cabin supported by the chassis;

a hood proximate to the rear end of the chassis; and a hood structure for supporting the hood, the hood structure including a first frame member coupled to the chassis proximate to the rear end and a second frame member disposed distal to the rear end and proximal to the operator cabin, wherein the second frame member is coupled to the chassis by a mounting assembly, the mounting assembly including:

a plate member connected to the second frame member, the plate member having a first end and a second end;

a first mounting device connecting the first end of the plate member to the chassis, wherein the first mounting device defines a first through-aperture adapted to align with a first opening in the plate member, wherein the first opening in the plate member and the first through-aperture in the first mounting device align with a first aperture in the chassis for receiving a first mechanical fastener therethrough, and wherein the first mechanical fastener is adapted to couple the plate member to the chassis proximate to the first end of the plate member; and a second mounting device connecting the second end of the plate member to the chassis.

2. The construction vehicle of claim 1, wherein each of the first and second mounting devices includes an isolation mount.

3. The construction vehicle of claim 1, wherein the first opening in the plate member is adapted to receive a first sleeve member of the first mounting device, and wherein the plate member includes a second opening adapted to receive a second sleeve member of the second mounting device.

4. The construction vehicle of claim 1, wherein the second mounting device defines a second through-aperture adapted to align with a second opening in the plate member.

5. The construction vehicle of claim 4, wherein the second opening in the plate member and the second through-aperture in the second mounting device align with a second aperture in the chassis for receiving a second mechanical fastener therethrough, and wherein the second mechanical fastener is adapted to couple the plate member to the chassis proximate to the second end of the plate member.

6. The construction vehicle of claim 1, wherein the second frame member defines a first slot and a second slot.

7. The construction vehicle of claim 6, wherein the plate member defines a first through-hole that aligns with the first slot in the second frame member for receiving a third mechanical fastener and a second through-hole that aligns with the second slot in the second frame member for receiving a fourth mechanical fastener, and wherein the third and fourth mechanical fasteners are adapted to couple the second frame member to the plate member.

8. The construction vehicle of claim 7, wherein each of the first and second through-holes includes helical threads.

9. A wheel loader comprising:

a chassis having a front end and a rear end opposite to the front end;

an operator cabin supported by the chassis;

a hood proximate to the rear end of the chassis; and a hood structure for supporting the hood, the hood structure including a first frame member coupled to the chassis proximate to the rear end and a second frame member disposed distal to the rear end and proximal to the operator cabin, wherein the second frame member is coupled to the chassis by a mounting assembly, the mounting assembly including:

a plate member connected to the second frame member, the plate member having a first end and a second end, wherein the second frame member defines a first slot and a second slot, wherein the plate member defines a first through-hole that aligns with the first slot in the second frame member for receiving a third mechanical fastener and a second through-hole that aligns with the second slot in the second frame member for receiving a fourth mechanical fastener, and wherein the third and fourth mechanical fasteners are adapted to couple the second frame member to the plate member;

a first mounting device connecting the first end of the plate member to the chassis; and a second mounting device connecting the second end of the plate member to the chassis.

10. The wheel loader of claim 9, wherein each of the first and second mounting devices includes an isolation mount.

11. The wheel loader of claim 9, wherein the plate member includes a first opening adapted to receive a first sleeve member of the first mounting device and a second opening adapted to receive a second sleeve member of the second mounting device.

12. The wheel loader of claim 9, wherein the first mounting device defines a first through-aperture adapted to align with a first opening in the plate member.

13. The wheel loader of claim 12, wherein the first opening in the plate member and the first through-aperture in the first mounting device align with a first aperture in the chassis for receiving a first mechanical fastener therethrough, and wherein the first mechanical fastener is adapted to couple the plate member to the chassis proximate to the first end of the plate member.

14. The wheel loader of claim 9, wherein the second mounting device defines a second through-aperture adapted to align with a second opening in the plate member.

15. The wheel loader of claim 14, wherein the second opening in the plate member and the second through-aperture in the second mounting device align with a second aperture in the chassis for receiving a second mechanical fastener therethrough, and wherein the second mechanical fastener is adapted to couple the plate member to the chassis proximate to the second end of the plate member.

16. The wheel loader of claim 9, wherein each of the first and second through-holes includes helical threads.

* * * * *